US006298703B1

(12) United States Patent
Focken et al.

(10) Patent No.: US 6,298,703 B1
(45) Date of Patent: Oct. 9, 2001

(54) ROLL FOR A RADIAL THREAD-ROLLING HEAD

(75) Inventors: Andreas Focken, Schwarzenbek; Klaus Oppelt, Lauenburg, both of (DE)

(73) Assignee: Wilhelm Fette GmbH, Schwarzenbek (DE)

( * ) Notice: Subject to any disclaimer, the term of this patent is extended or adjusted under 35 U.S.C. 154(b) by 0 days.

(21) Appl. No.: 09/510,025

(22) Filed: Feb. 22, 2000

(30) Foreign Application Priority Data

Apr. 22, 1999 (DE) ..... 299 07 128 U

(51) Int. Cl.[7] ..... B21H 3/04
(52) U.S. Cl. ..... 72/103; 72/477
(58) Field of Search ..... 72/102, 103, 104, 72/108, 118, 477

(56) References Cited

U.S. PATENT DOCUMENTS 516,764 * 3/1894 Fairbairn et al. ..... 72/104

FOREIGN PATENT DOCUMENTS 23 35 651 5/1975 (DE) .
39 30 131 3/1991 (EP) .
1-215425 * 8/1989 (JP) ..... 72/108

* cited by examiner

*Primary Examiner*—Lowell A. Larson
(74) *Attorney, Agent, or Firm*—Vidas, Arrett & Steinkraus P.A.

(57) ABSTRACT

A roll for a radial thread-forming head which has disposed at its circumference a thread-forming profile with a flattened area, a thread entry portion, a thread calibrating portion, and a thread exit portion, characterized in that an annular, continuous groove portion is formed in the longitudinal half of the roll in a radial plane at the circumference, except for the flattened area, and a thread-forming profile is formed in the two sides of the groove portion wherein the pitches of the thread-forming profiles are opposed and the positions of the flattened areas are coincident.

7 Claims, 1 Drawing Sheet

ROLL FOR A RADIAL THREAD-ROLLING HEAD

BACKGROUND OF THE INVENTION

1. Field of the Invention

This invention relates to a roll for a radial thread-rolling head.

2. Description of the Related Art

In a radial thread-rolling head which has two or three rolls fitted with a thread-forming profile, such rolls are supported in a radially adjustable relationship. The thread-forming profile, as viewed in a circumferential direction, has a flattened area, a thread entry portion, a thread calibrating portion, and a thread exit portion. For reasons of forming and reasons of the torque to be applied by the machine, the aforementioned portions extend over a certain angle. Thus, the flattened area will usually extend over an angle of about 40°, the entry portion over an angle of 160°, the calibrating portion over an angle of 90°, and the exit portion over an angle of 70°. The length of the calibrating portion usually is such as to correspond to a multiple of the circumferential length of the work to be formed.

It is by means of such a radial thread-rolling head that a thread is formed into a work over a restricted length. The rolls, when in their initial position, have a rotational position such that the flattened areas face each other. In this position of the rolls, the work may be inserted in the thread-rolling head. The rolls which are released by hand or automatically by the machine tool are automatically advanced radially towards the work so that the work, while being rotated by the machine tool, is capable of carrying the forming rolls along. The rolling operation will be completed after a single rotation of thread-forming rolls.

The thread-forming rolls are rotated by frictional engagement between the work and thread-forming rolls, and a spring mechanism is tensioned, and a clutch will be locked in place upon completion of the rolling operation so that the thread-forming rolls will release the work again.

Such a thread-rolling head or the forming rolls for such thread-rolling heads are known, for example, from DE 39 30 131 C1 or the Fette company publication "Rollsysteme".

Fortunately, rolls are of a certain axial length. This cannot be changed any more for a given version of a rolling head. On the other hand, what occurs in a number of applications is that the thread-forming roll is only utilized over a restricted axial area. This area will wear with time whereas the rest of the area remains usable, but is not used because of its position.

Therefore, it is an object of the invention to create a forming roller for a radial thread-rolling head, which is particularly useful in efficiently forming short threaded portions, but permits to be utilized completely.

SUMMARY OF THE INVENTION

In the inventive roll, an annular, continuous groove portion is formed in the longitudinal half of the roll in a radial plane on the circumference. This groove portion does not extend into the flattened area or it is unnecessary to pass it into this area. Formed in the two sides of the groove portion is a thread-forming profile each the pitches of which are opposed, the flattened areas of the thread-forming profiles being directed towards each other. In other words, if one thread-forming profile has been designed for a right-hand thread the other thread-forming profile will be suited for a right-hand thread as well when the roll is turned through 180° in the rolling head. It is possible to form identical threads using identical thread-forming profile portions in the work. However, it is also possible to use different thread-forming profiles such as those having different pitches, but also of different diameters. In addition, the elevation rate of thread-forming profiles may differ. The elevation rate is to be understood as the beginning of the entry portion which is radially displaced inwardly from the profile height in the calibrating portion, the thread-forming portion proper.

The groove portion ensures that the work does not get in engagement with the second thread-forming profile portion while the thread is being produced. Hence, according to a further aspect of the invention, the width of the nut at least corresponds to the pitch of the thread-forming profile plus a certain amount for overrun. Also, the groove is preferably intended to exhibit a minimum depth which is equal to the height of the profile plus a minimum elevation rate for entry.

BRIEF DESCRIPTION OF THE DRAWINGS

A detailed description of the invention is hereafter described with specific reference being made to the drawings in which.

DESCRIPTION OF THE PREFERRED EMBODIMENTS

Figure 1:
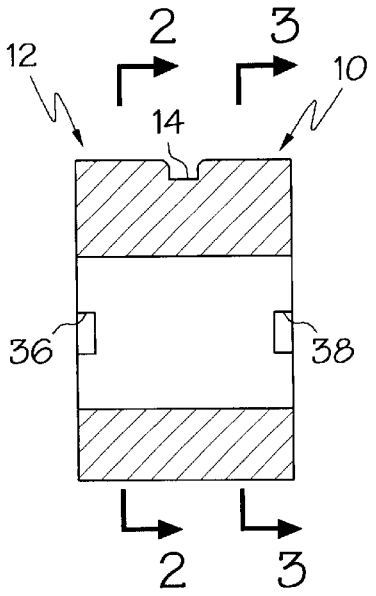
FIG. 1 shows, in a section, a thread-forming roll for a radial thread-forming head according to the invention.
Figure 2:
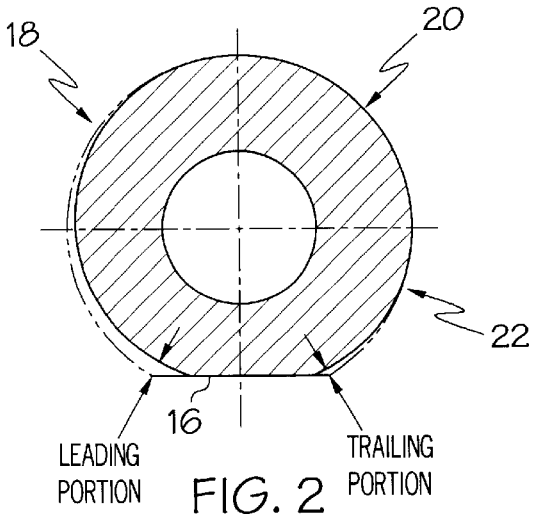
FIG. 2 shows a section through the illustration of FIG. 1 taken along line 2—2.
Figure 3:
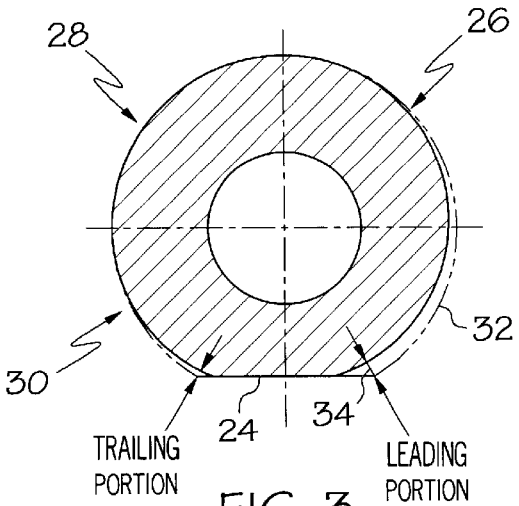
FIG. 3 shows a section through the illustration of FIG. 1 taken along line 3—3.

The thread-forming roll shown in FIGS. 1 to 3 has two thread-forming profiled portions 10, 12 which are separated from each other by a groove 14. The thread-forming profile 12 has a flattened area 16, an entry portion 18 extending approximately over 160°, a calibrating portion 20 extending over about 90° and an exit portion 22 extending approximately over 70°. The profiled portion 10 has a flattened area 24, an entry portion 26, a calibrating portion 28, and an exit portion 30. As can be deduced from FIGS. 2 and 3 the flattened areas 16, 24 are directed towards each other and the remaining areas of the thread-forming profiles are equal, but symmetrical with the central plane which is straddled by the groove 14. In other words, the respective thread-forming portion 10, 12, depending on the position of the roll in the radial thread-rolling head (not shown), will act in the same way on the work (not shown either) with which it gets into engagement. Identical threads will be produced depending on which thread-forming profile 10, 12 is employed. Hence, if the profiled portion 10 is worn the roll in the thread-rolling head will be turned through 180° and employed so as to use the profiled portion 12 now. Thus, the profiled roll may be utilized over its full length, which results in a significant service life of the roll. Although this only applies to relatively short threaded portions which are to be formed these applications are relatively frequent.

However, it is not obligatory for the thread-forming profiled portions 10, 12 to be identical. On the contrary, they may have a different pitch and even a different elevation rate. As can be seen from FIGS. 2 and 3 the profile height of the entry portion is radially displaced inwardly from that of the calibrating portion. This is outlined in FIG. 3 by the dotted line 32, which represents the final profile height. The radial displacement, which is indicated as 34, is also referred to as the elevation rate. Likewise, there is a retraction of the profile height towards the flattened areas 16 and 24 in the exit portion 22 and 30 to facilitate the exiting motion of the roll on the work.

As can be seen from FIG. 1 recesses 36 and 38 are diametrically formed on opposed sides. They serve for causing a catch disk of the thread-rolling head to engage the roll. This ensures, via an appropriate gearing, that when the thread-forming roll performs a single rotation a spring is tensioned which, when released, will ensure that the thread-forming rolls are moved towards each other in order that the flattened area gets engaged with the work.

Figure 4:
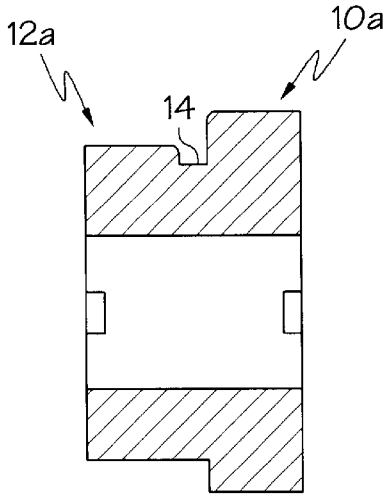
FIG. 4 shows a section through a thread-forming roll according to another embodiment of the invention.

In FIG. 4, there is shown a thread-forming roll which has two thread-forming profiled portions 10*a,* 12*a* separated by a groove 14. Groove 14 corresponds to groove 14 of FIG. 1. Unlike in FIG. 1 the thread-forming profiled portions 10*a,* 12*a* are of different diameters.

It should be noted for groove 14 that it is of a width that is somewhat larger than the pitch of the thread-forming profiled portions. This enables a certain amount for overrun in forming the thread on the work. The depth of groove 14 corresponds to the profile height of the thread-forming profiled portions plus a minimum elevation at entry. This eliminates the need of a groove in the flattened areas 16 and 24.

This completes the description of the preferred and alternate embodiments of the invention. Those skilled in the art may recognize other equivalents to the specific embodiment described herein which equivalents are intended to be encompassed by the claims attached hereto.

What is claimed is:

1. An integral roll for a radial thread rolling head for forming a thread into a workpiece, the integral roll having an axial length and a circumference, the integral roll comprising:

two thread-forming profiles (10, 12, 10*a,* 12*a*), the two thread-forming profiles being disposed at the circumference and being axially arranged in series, the two thread-forming profiles having pitches which are opposed, each of the two thread-forming profiles having a profile height and a profile diameter, each of the two thread-forming profiles include a flattened portion (16,24), an entry portion, a calibrating portion and an exit portion, the two thread-forming profiles constructed and arranged such that the flattened portions, the entry portions, the calibrating portions and the exit portions of one of the two thread-forming portions come into contact with the workpiece during operation, the flattened portions of both of the thread-forming profiles being opposingly aligned; and a continuous groove portion (14) disposed about the circumference, the groove portion being positioned midway along the axial length and having a predetermined width and extending to a predetermined depth in a radial plane between the two thread-forming profiles, the groove portion not extending into the flattened portion.

2. The integral roll according to claim 1, wherein the two thread-forming profiles (10, 12) are identical.

3. The integral roll according to claim 2 wherein the two thread-forming profiles each have an elevation rate, the elevation rate of each of the two thread-forming profiles being different.

4. The integral roll according to claim 3 wherein the predetermined depth of the groove portion (14) corresponds to the profile height of each of the two thread-forming profiles and the elevation rate at entry (34) of each of the two thread-forming profiles.

5. The integral roll according to claim 1, wherein the two thread-forming profiles are different.

6. The integral roll according to claim 1, wherein the profile diameters of each of the two thread-forming profiles (10*a,* 12*a*) are different.

7. The integral roll according to claim 1, wherein the predetermined width of the groove (14) substantially corresponds to the pitch of the two thread-forming profiles.

* * * * *